United States Patent [19]

Kumatsu

[11] Patent Number: 4,473,349

[45] Date of Patent: Sep. 25, 1984

[54] LIQUID HYDROCARBON FUEL COMBUSTOR

[76] Inventor: Akihiko Kumatsu, 39, Furuyashiki, Kowa, Mihama-Cho, Chita-gun, Aichi, Japan

[21] Appl. No.: 496,491

[22] Filed: May 17, 1983

[30] Foreign Application Priority Data

May 17, 1982 [JP] Japan ..... 57-83799

[51] Int. Cl.[3] ..... F23M 9/06

[52] U.S. Cl. ..... 431/116; 431/172; 431/347; 431/265

[58] Field of Search ..... 431/115, 116, 171, 172, 431/265, 347

[56] References Cited

U.S. PATENT DOCUMENTS 3,741,166 6/1973 Bailey ..... 431/116

3,799,732 3/1974 Wilhelm ..... 431/347

*Primary Examiner*—Carroll B. Dority, Jr.

*Attorney, Agent, or Firm*—Wenderoth, Lind & Ponack

[57] ABSTRACT

Herein disclosed is a liquid hydrocarbon fuel combustor which includes a fresh air blast pipe disposed in a hole formed in the circumferential wall of a can-type body. The leading end of the blast pipe is opened toward a combustion chamber which is formed in the can-type body. A fuel atomizing nozzle is disposed in the blast pipe for atomizing a liquid hydrocarbon fuel from the leading end opening of the blast pipe into the combustion chamber. An electrode rod is disposed in the blast pipe for igniting and burning the mixture of the liquid fuel droplets, which are injected from the atomizing nozzle, and the fresh air which is blown from the blast pipe. A mixing tube is disposed in front of the leading end opening of the blast pipe in the atomizing direction such that it is coaxially connected to the blast pipe. The mixing tube has at least its front half counter-tapered in a diverging form. A flame holding plate is fixed upright in the mixing tube in a manner to face the atomizing direction of the nozzle and has a porous or reticulated construction. The connecting portion of the blast pipe and the mixing tube is formed with a gap which is so sized as to allow the combustion gas circulating along the inner wall of the combustion chamber to flow into a rear end opening of the mixing tube.

4 Claims, 5 Drawing Figures

LIQUID HYDROCARBON FUEL COMBUSTOR

BACKGROUND OF THE INVENTION

1. Field of the Invention

The present invention relates to a petroleum water heater and, more particularly, to a liquid hydrocarbon fuel combustor to be used with the water heater or the like.

2. Description of the Prior Art

As burning means for burning a liquid hydrocarbon fuel, there has been available in the prior art what is called a "gun-type burner". This burner ignites a mixture of air, which is blown from a blower motor, and kerosene droplets, which are pressurized by an electromagnetic pump and atomized by a nozzle, by a high-voltage discharge thereby to burn that mixture. Nevertheless, the gun-type burner generally has a high ratio of excess air so that it has an accordingly low heat efficiency. Because of the yellow or yellowish-orange flame combustion, moreover, carbon left unburned deposits on the inner wall of the can-type body of the burner thereby to deteriorate the initial efficiency, and the resultant burning noises are large. From the standpoint of economy of energy and resources, therefore, there arises a requirement for improving the efficiency, or, from the standpoint of prevention of noises to the neighbourhood in urban lives, there arises a requirement for dropping the sound level of the noises. In order to meet those requirements, there has been developed a combustion system such as a rotary gas burner or a heater evaporation system, in which kerosene droplets are gasified to ensure the blue flame combustion. However, the former system has a defect that an offensive order is emitted as a result of the incomplete gasification of the kerosene during the time period from the ignition to the instant when the flame become stable and at the time when the flame is quenched. On the other hand, the latter system is inconvenient, when used, in that the combustion cannot be instantly started because of necessity for a time period for preheating the heater, and has a difficulty that a control mechanism such as a mechanism for controlling the temperature of the heater has a complicated construction. Both the systems are basically improved in that the kerosene droplets are gasified but they are so complicated as to require special skills when they are maintained and are to be inspected. The present invention is directed to what is called a "recirculation system", as is different from those systems according to the prior art. The recirculation system is known in the art as one of countermeasures for reducing emission of nitrogen oxides $NO_x$ from boilers for business use. According to the recirculation system, the flame is changed into a blue one by the use of a remarkably large-scale apparatus for recirculating a portion of the combustion gas to the back of a fuel atomizing nozzle thereby to control the content of the $NO_x$ in the combustion gas. The application of that recirculation system as it is to a domestic petroleum water heater or the like has invited with difficulty the problems that the burning noises are large and that the running cost is high.

SUMMARY OF THE INVENTION

The present invention has been conceived with a view to eliminating all the defects of the various systems thus far described.

Therefore, it is an object of the present invention to provide a liquid hydrocarbon fuel combustor which can make use of such can-type body and gun-type burner as are generally used in the prior art.

Another object of the present invention is to provide a liquid hydrocarbon fuel combustor which has a simple construction.

A further object of the present invention is to provide a liquid hydrocarbon fuel combustor which is highly efficient but has low noises.

According to a major feature of the present invention, there is provided a liquid hydrocarbon fuel combustor comprising: a fresh air blast pipe disposed in a hole, which is formed in a portion of the circumferential wall of a cylindrical can-type body, and having its leading end opened toward a combustion chamber which is formed in said can-type body; a fuel atomizing nozzle disposed in said blast pipe for atomizing a liquid hudrocarbon fuel from the leading end opening of said blast pipe into said combustion chamber; an electrode rod for igniting and burning the mixture of the liquid hydrocarbon fuel droplets, which are injected from said fuel atomizing nozzle, and the fresh air which is blown from said blast pipe; a mixing tube disposed in front of the leading end opening of said blast pipe in the atomizing direction such that it is coaxially connected to said blast pipe and having at least its front half counter-tapered in a diverging form; and a flame holding plate fixed upright in said mixing tube in a manner to face the atomizing direction of said fuel atomizing nozzle and having a porous or reticulated construction, wherein the improvement resides in that the connecting portion of said blast pipe and said mixing tube is formed with a gap which is so sized as to allow the combustion gas circulating along the inner wall of said cylindrical combustion chamber to flow into a rear end opening of said mixing tube.

BRIEF DESCRIPTION OF THE DRAWINGS

Other objects, features and advantages of the present invention will become more apparent from the following description taken in conjunction with the accompanying drawings, in which:

FIG. 1 is a longitudinal section showing a heat exchanger;

FIG. 2 is a transverse section showing the heat exchanger;

FIG. 3 is a transverse section showing a combustor; and

FIG. 4 is a partially sectional perspective view showing the combustor; and

DESCRIPTION OF THE PREFERRED EMBODIMENTS

Figure 1:
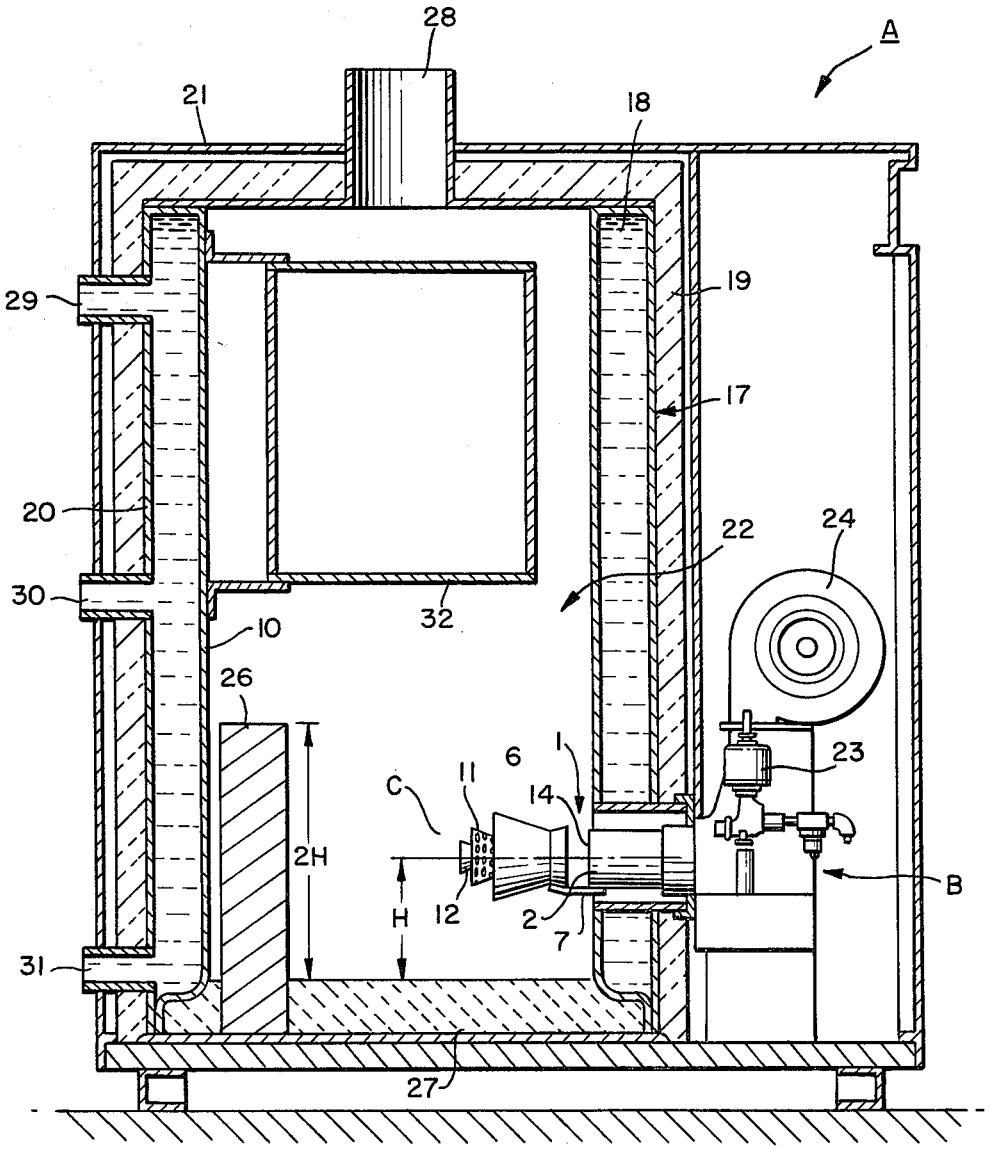
In FIGS. 1 to 4 showing a first embodiment of the present invention.
Figure 2:
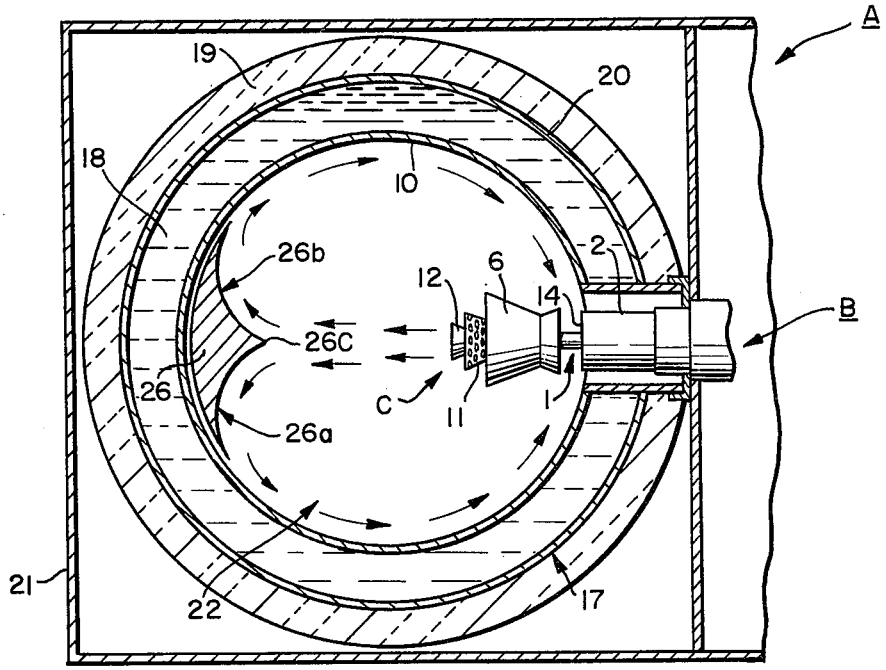
Figure 3:
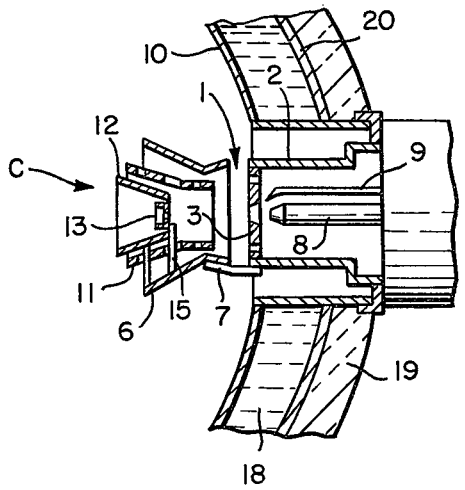
Figure 4:
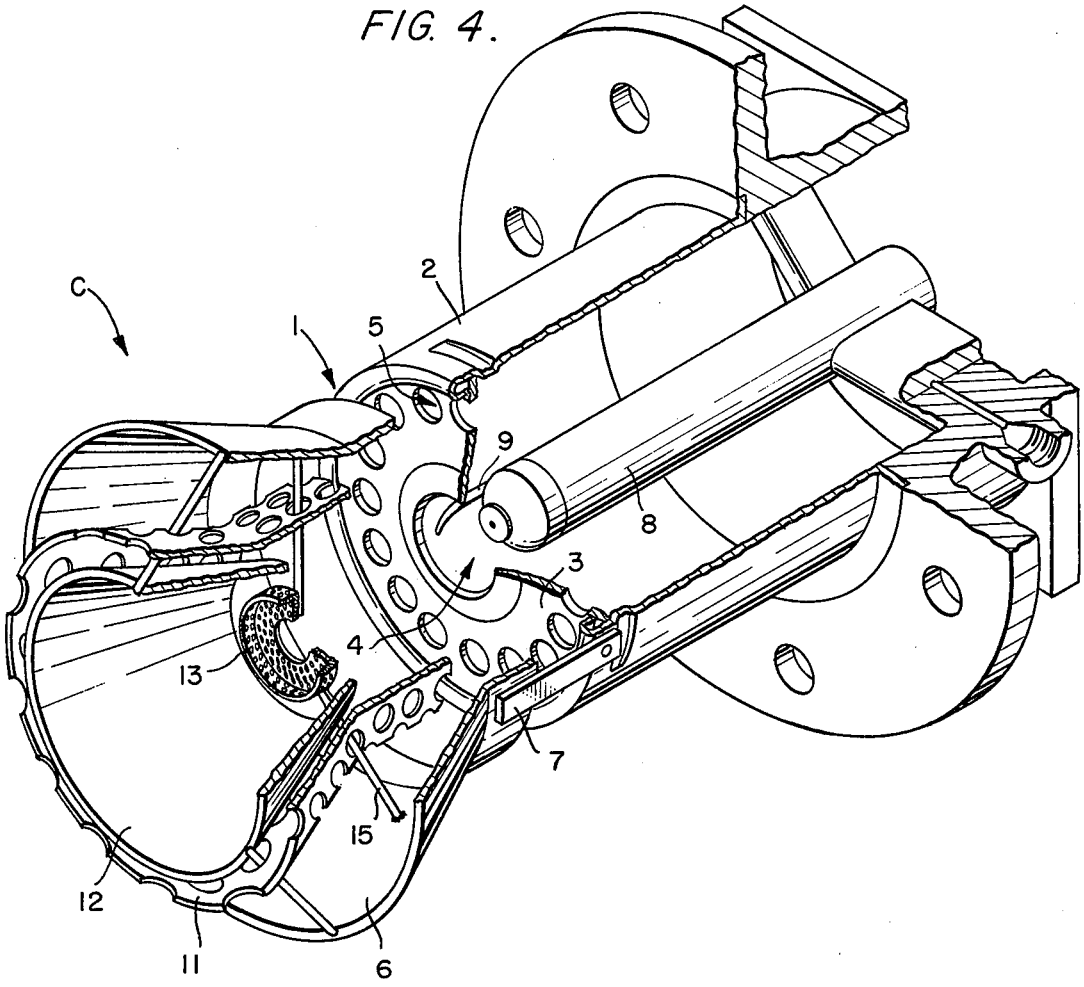

The present invention will be described in detail in the following in connection with the embodiments thereof with reference to the accompanying drawings.

FIGS. 1 to 4 show a heat exchanger A according to a first embodiment of the present invention. As shown, the heat exchanger A is constructed of a cylindrical can-type body 17 and a combustor B which are disposed in a housing 21. The combustor B is disposed to face a combustion chamber which is formed in the internal space of the can-type body 17. Between the inner wall 10 and the outer wall 20 of the can-type body 17, moreover, there is formed a reservoir 18 in which a fluid to be heat-exchanged is reserved. Indicated at reference number 19 is a insulator which is arranged on the outer circumference of the can-type body 17.

The combustor B is equipped with a fuel atomizing nozzle 8 for injecting the liquid hydro-carbon fuel, which is pressurized by a hydraulic pump 23, in the form of mist-shaped fine droplets. Around the outer circumference of said nozzle 8, there is disposed a blast pipe 2 for blowing the air which is sent by a blower fan 24. Indicated at numeral 3 is a swirling air flow injection plate which is disposed at the leading end opening 14 of the blast pipe 2. That injection plate 3 is formed at its central portion with one fuel injection port 4 for injecting an air-fuel mixture and at its circumferential edge portion with a plurality of (e.g., six or more) air injection ports 5 which are so equi-distantly arranged as to enclose said fuel injection port 4. Those air injection ports 5 are inclined at such respective angles with respect to the circumferential and axial directions of the injection plate 3 as to establish swirling flows in the air injected therefrom so that the fuel and the air may be uniformly mixed. Indicated at numeral 9 is an electrode rod which is connected with the secondary (i.e., higher voltage side) terminals of an ignition transformer for establishing a spark in the vicinity of the leading end of the fuel atomizing nozzle 8 thereby to ignite the fine droplets of the fuel which is injected from said atomizing nozzle 8. In front of and at a predetermined spacing from said blast pipe 2, there is disposed a flame holder C which has a multi-cylinder construction. That spacing needs to have such dimentions that the combustion gas to circulate along the inner wall 10 of the cylindrical combustion chamber 22 can flow into the rear end opening of a mixing tube 6. Hence, that spacing will be termed a circulating flow inlet 1 in the following. The multi-cylinder flame holder C is equipped at its center with a flame holding plate 13 which is made of a punched stainless steel plate. Said flame holding plate 13 is supported on the inner circumference of the mixing tube 6, which in turn is suspended on the blast pipe 2 by means of legs 7, by means of supporting legs 15. Around the outer circumference of the flame holding plate 13, moreover, there is disposed a counter-tapered flame holding member 12 which is made of a finely porous material and which diverges toward the downstream. Around the outer circumference of that flame holding member 12, still moreover, there is disposed an auxiliary flame holding member 11 which is fabricated by punching a stainless steel plate. The flame holding member 12 is used to increase stability of a combustion flame whereas the auxiliary flame holding member 11 is used to smoothen propagation of a flame front when the orange flame combustion shifts to the blue flame combustion immediately after the start of the combustion. Those flame holding members makes laminar the flow of the mixture, which contains the fine droplets of the combustible liquid fuel and the gasified liquid fuel, thereby to augment the stability of the combustion flame.

On the inner wall 10 of the can-type body 17 and at the side facing the fuel atomizing nozzle 8, on the other hand, there is disposed a guide 26 for smoothly shunting the combustion gas thereby to prevent turbulences from being generated. That guide 26 is formed at its center with a projecting ridge **26*c* at which its two sides 26*a* and 26*b* merge into each other. Moreover, the aforementioned two sides 26*a* and 26*b* are curved the more to the right and left in the more downstream of the combustion gas. Still moreover, the guide 26 thus constructed is set to have such a height from a refractory base 27 placed on the bottom of the combustion chamber 22 as is twice as large as the height H of the flame holder C of the combustor B. This construction is adopted so that the combustion gas injected to diverge vertically to some extent from the flame holder C may be wholly made to circulate. Reference numeral 28 indicates an exhaust funnel, and numerals 29, 30 and 31 indicate an outlet port, an inlet port and a drain, respectively, of the fluid to be heat-exchanged. Indicated at numeral 32** is a control cylinder for preventing the combustion gas from being straightly exhausted.

Next, the operating modes of the heat exchanger A having the construction thus far described will be described in case the fluid to be heat-exchanged is water whereas the liquid fuel is kerosene. Here, both the flow rates of the fuel and air to be supplied per unit time to the combustor B are constant. The fresh air supplied via the opening 14 of the blast pipe 2 from the blower motor (although not shown) is fed to the mixing tube 6 which is disposed in front of said blast pipe 2. After this, the fuel pressurized by the hydraulic pump (although not shown) is atomized into the mixing tube 6 by the atomizing nozzle 8 which is arranged toward the combustion chamber 22 in the cylindrical can-type body 17. Simultaneously with the start of the air blowing operation, moreover, the droplets of the liquid fuel, which are atomized by the fuel atomizing nozzle 8, are ignited by the flame, which is generated at the electrode rod 9 by the high voltage generated by the ignition transformer (although not shown), so that the orange flame combustion is started from the vicinity of the opening 14 of the blast pipe 2. The resultant combustion gas impinges upon the guide 26 which is arranged at such a position on the inner wall 10 of the can-type body as faces the flame holder C. The combustion gas is then shunted by the projecting ridge **26*c* at the center of that guide 26 to flow along the surfaces of the curved sides 26*a* and 26*b* so that the two flows gently and smoothly change their directions. After this, the combustion gas flows along the inner wall 10 of the can-type body while exchanging its heat with the water in the reservoir 18. Then, the combustion gas reaches the circulating flow inlet 1, which is formed between the flame holder C and the blast pipe 2 and in which it is sucked into the mixing tube 6 by the actions of both the vacuum (or suction) established by the high-speed swirling air flow coming from the swirling air flow injection plate 3 and the dynamic combustion pressure of the circulating combustion gas itself. Within the mixing tube 6, the fresh air and the liquid fuel droplets are appropriately mixed with the combustion gas coming in a circulating manner so that the liquid fuel droplets are activated by the heat of the combustion gas circulating either to become more finer or to be gasified, until the mixture is fed toward the flame holding plate 13 disposed in the atomizing direction. As a result, the flame burning in the vicinity of the opening 14 of the blast tube 2 is gradually moved in the atomizing direction. The flame thus moved is propagated first to the rear end portion of the auxiliary flame holding member 11 and then to the flame holding plate 13, in which it starts the continuous and stable blue flame combustion. After that, the combustion gas continues its recirculation so that, when the mixing rate of the fresh air with both the combustion gas having recirculated and the liquid fuel droplets reaches a proper value, the flame expands its combustion range along the counter-tapered inner wall downstream of the mixing tube 6, whereby the continuous blue flame combustion is stably held at the flame holding plate 13 and over a wide area of the inner wall downstream of the mixing tube 6**. In other words, it is possible to establish the combustion which has low noises and an excellent heat efficiency.

In order to ensure the aforementioned blue flame combustion, thus, it is necessary to mix a appropriate amount of combustion gas with the mixutre of the air and the liquid fuel droplets. Then, the level of the vacuum (or suction) generated in the circulating flow inlet 1 raises a problem. With this problem in mind, the inventor has conducted experiments by changing the flow speed of the air to be injected, which will exerts the most influence upon the aforementioned vacuum. The experimental results have revealed that the flow speed sufficient to suck such a flow rate as is necessary for the ideal ratio of excess air can be set if the dimensions of the combustor are determined. The factors to exert influences upon the flow speed of the air injected include the internal diameters of the fuel injection port 4 and the air injection ports 5 and the area ratio of the two injection ports 4 and 5, if the output of the blower fan 24 and the size (e.g., 80 mmϕ, in this case) of the blast pipe 2 are constant. Incidentally, the number of the air injection ports 5 and the distance between the fuel injection port 4 and the air injection ports 5 hardly influence the flow speed of the injected air so that they can be neglected. If the distance between the two injection ports 4 and 5 exceeds its proper value, however, it becomes impossible to ensure satisfactory mixing of the liquid fuel droplets and the air. In the case of the present embodiment in which the blast pipe 2 has an internal diameter of 80 mmϕ, the above-specified proper distance is 32 mm.

Tables 1 and 2 tabulate the experimental results and indicate the relationships among the internal diameters of the injection ports 4 and 5, the flow speed of the injected air and the flow rate of the air supplied. Incidentally, the experiments were conducted outside of the heat exchanger A.

TABLE 1

| Internal diameter of blast pipe 2 = 80 mmØ<br>Internal diameter of injection port 4 = 18 mmØ | | | |
|---|---|---|---|
| No. of Ports 5 | I.D. (mmØ) of Ports 5 | Flow Speed (m/sec) | Flow Rate of Air Supplied ($m^3$/sec) |
| 16 | 7.0 | 22 | 0.019 |
| 16 | 7.5 | 21.5 | 0.021 |
| 16 | 8.0 | 21 | 0.022 |
| 16 | 8.5 | 19.5 | 0.023 |
| 16 | 9.0 | 19 | 0.024 |

As is apparent from Table 1, it the internal diameter of the air injection ports is made small, the flow speed of the air injected is increased to enlarge the vacuum to be established in the circulating air inlet 1. On the contrary, the flow rate of the air supplied for the combustion has a tendency to be decreased as the internal diameter of the injection ports 5 is reduced. With this in mind, therefore, the internal diameter of 8 mmϕ is required for having a sufficient flow rate of the air supplied and a high flow speed.

TABLE 2

| Internal diameter of blast pipe 2 = 80 mmϕ<br>Number of injection ports 5 = 16<br>Internal diameter of injection ports 5 = 8 mmϕ | | | |
|---|---|---|---|
| I.D. of Port 4 | Effective Area of Port 4 / Total Effective Area of Ports 4 & 5 × 100(%) | Flow Speed (m/sec) | Flow Rate of Air Supplied ($m^3$/sec) |
| 16 | 20 | 21 | 0.021 |
| 18 | 24 | 21 | 0.022 |
| 20 | 28 | 20 | 0.022 |
| 22 | 32 | 19.5 | 0.023 |
| 24 | 36 | 19 | 0.024 |

As is apparent from Table 2, moreover, if the internal diameter of the fuel injection port 4 is reduced, the flow speed is increased, but the flow rate of the air supplied is decreased. Moreover, the ratio of the effective area of the fuel injection port 4 to the total effective area of the fuel injection port 4 and the air injection ports 5 takes such a value as accords to the change in the flow rate of the air supplied. With the balance between the flow rate of the air supplied and the flow speed of the injected air flow being taken into consideration, therefore, the internal diameter of the fuel injection port 4 has the most proper value of 18 to 20 mmϕ.

The air flow speed actually metered was 21 m/sec for the internal diameter 18 mmϕ of the fuel injection port 4, the internal diameter 8 mmϕ of the air injection ports 5, the number 16 of the air injection ports 5 and the internal diameter 80 mmϕ of the blast pipe 2. For reference pupose only, the air flow speed of the combustor of the prior art, which is commercially available in the market, is ordinally about 12.5 m/sec.

In short, according to the first embodiment, the guide 26 for shunting the combustion gas and gently and smoothly changing the flow direction of the same is disposed at a position where the combustion gas impinges upon the inner wall 10 of the can-type body so that the combustion gas generates no substantial turbulences at said portion while being freed from any large noises which might otherwise be generated by the turbulences. In the mixing tube 6, moreover, since the liquid fuel droplets are heated into a gasified or near state by the circulating combustion gas and since the combustion is effected with the blue flame at a ratio of excess air near the stoichiometric value by adding the combustion gas to the mixture of the air and the liquid fuel droplets, the calory to be liberated for a predetermined amount of fuel is so high that an excellent heat efficiency can be attained. Since the combustion is sustained with the laminar, stable blue flame, still moreover, there can be achieved an advantage that the burning noises are low. Since the carbon generated is little, furthermore, it does not deposit upon the inner wall of the can-type body so that the efficiency is not degraded.

Table 3 compares the performances of the petroleum water heater using the gun-type burner of the prior art and the petroleum water heater using the recirculation type burner according to the first embodiment of the present invention.

TABLE 3

| | Prior Art | Invention |
|---|---|---|
| Efficiency | 75% | 90% |
| A - Noise (by JIS) | 50 dB | 42 dB |
| C - Noise | 70 dB | 62 dB |

TABLE 3-continued

| | Prior Art | Invention |
|---|---|---|
| (by JIS) | | |
| Temp. of Exhaust Gas | 450° C. | 280° C. |
| Smoke Scale No. | 2 | 0 |
| $CO_2$ (%) | 10 | 14 |

Since substantially instant shift is effected from the orange flame combustion to the blue flame combustion in accordance with the present invention, furthermore, little offensive order is emitted. Furthermore, interchangeability with the gun-type burner of the prior art can be enjoyed because use is made of the can-type body which is ordinally used. Thanks to the simple construction, furthermore, there can be attained advantages that the maintenance and inspection are facilitated and that the production cost is low.

Figure 5:
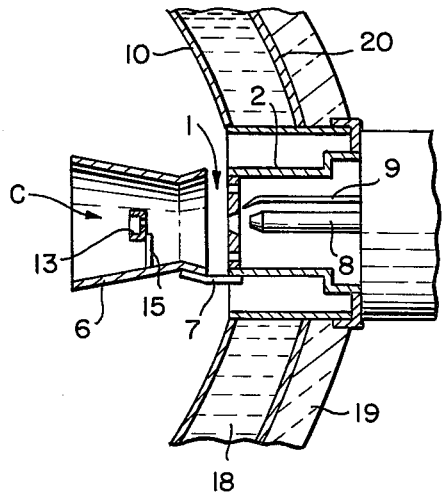
FIG. 5 is a transverse section showing a portion of a combustor according to a second embodiment of the present invention.

Turning now to FIG. 5 showing a second embodiment of the present invention, from which both the flame holding member 12 and the auxiliary flame holding member 11 of the foregoing first embodiment are omitted. The remaining struction is absolutely the same as that of the first example. Even with this simplified construction, the combustor, which can sufficiently endure the practical use and which is highly efficient while generating low noises, can be finally provided likewise the case of the first embodiment partly by properly selecting the distance between the blast pipe 2 and the mixing tube 6 and partly by adjusting the position of the flame holding plate 13 although the distance selection and the position adjustment are troublesome.

What is claimed is:

1. A liquid hydrocarbon fuel combustor comprising:

a fresh air blast pipe disposed in a hole, which is formed in a portion of the circumferential wall of a cylindrical can-type body, and having its leading end opened toward a combustion chamber which is formed in said can-type body;

a fuel atomizing nozzle disposed in said blast pipe for atomizing a liquid hydrocarbon fuel from the leading end opening of said blast pipe into said combustion chamber;

an electrode rod for igniting and burning the mixture of the liquid hydrocarbon fuel droplets, which are injected from said fuel atomizing nozzle, and the fresh air which is blown from said blast pipe;

a mixing tube disposed in front of the leading end opening of said blast pipe in the atomizing direction such that it is coaxially connected to said blast pipe and having at least its front half counter-tapered in a diverging form; and a flame holding plate fixed upright in said mixing tube in a manner to face the atomizing direction of said fuel atomizing nozzle and having a porous or reticulated construction, the connecting portion of said blast pipe and said mixing tube having a gap therebetween which is so sized as to allow the combustion gas circulating along the inner wall of said cylindrical combustion chamber to flow into a rear end opening of said mixing tube.

2. A liquid hydrocarbon fuel combustor as set forth in claim 1, wherein the leading end opening of said blast pipe is covered with a swirling air flow injection plate which is formed at its central portion with a fuel injection port and at its circumferential edge portion with at least six air injection ports which are arranged at inclinations and around said fuel injection port.

3. A liquid hydrocarbon fuel combustor as set forth in claim 1 or 2, wherein said flame holding plate is so fixed inside of a counter-tapered flame holding member coaxially inserted into the front half portion of said mixing tube and facing in the atomizing direction of said fuel atomizing nozzle.

4. A liquid hydrocarbon fuel combustor as set forth in claim 3, wherein there is coaxially fixed in the space between the outer circumference of said counter-tapered flame holding member and the inner circumference of said mixing tube an auxiliary flame holding member which is fabricated by punching a metal plate and which has its rear end opening positioned in front of the rear end opening of said mixing tube and at the back of said flame holding plate.

* * * * *